United States Patent [19]

Schirtzinger

[11] 4,030,310

[45] June 21, 1977

[54] MONOPOD DRILLING PLATFORM WITH DIRECTIONAL DRILLING

[75] Inventor: Joseph F. Schirtzinger, Pasadena, Calif.

[73] Assignee: Sea-Log Corporation, Pasadena, Calif.

[22] Filed: Mar. 4, 1976

[21] Appl. No.: 664,011

[52] U.S. Cl. ..... 61/86; 166/.5; 175/8; 175/5

[51] Int. Cl.[2] ..... E21B 7/12; E21B 7/04; E21B 15/02

[58] Field of Search ..... 61/46, 46.5; 175/8, 175/9, 61, 5; 166/.5

[56] References Cited

UNITED STATES PATENTS

| | | | |
|---|---|---|---|
| 3,670,507 | 6/1972 | Mott et al. | 175/9 |
| 3,871,184 | 3/1975 | Schritzinger | 61/46.5 |
| 3,899,032 | 8/1975 | Rees et al. | 175/9 |

FOREIGN PATENTS OR APPLICATIONS

| | | | |
|---|---|---|---|
| 995,539 | 6/1965 | United Kingdom | 61/46.5 |

*Primary Examiner*—Paul R. Gilliam
*Assistant Examiner*—Alexander Grosz
*Attorney, Agent, or Firm*—Christie, Parker & Hale

[57] ABSTRACT

Apparatus for providing directional drilling from an offshore drilling platform, the drilling platform being of monopod construction with a submerged base, a single vertical column extending up from the base and supporting a platform above the water, the column having a vertical moon pool extending downwardly from the platform and opening in the base. A conductor pipe for receiving a drill string from a drilling rig mounted on the platform extends from the platform through the moon pool, the conductor pipe curving in an arc. The conductor pipe is supported vertically at its upper end. The conductor pipe is supported at the lower end at a position displaced from the center of the moon pool. The upper and lower supports permit rotation of the conductor pipe about a common vertical axis, the radial displacement of the lower end of the conductor pipe from this axis due to the curvature of the pipe being adjustable.

10 Claims, 5 Drawing Figures

Fig. 1
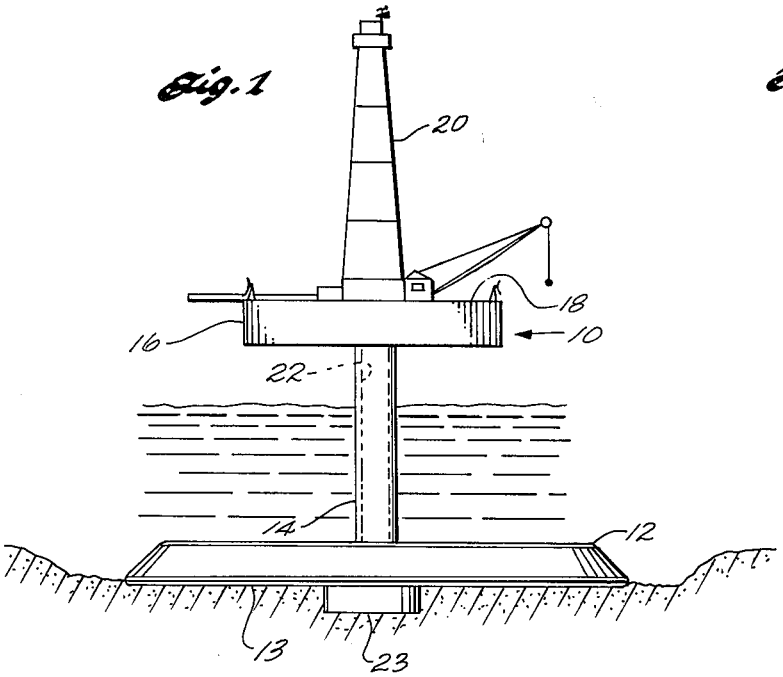
Fig. 2
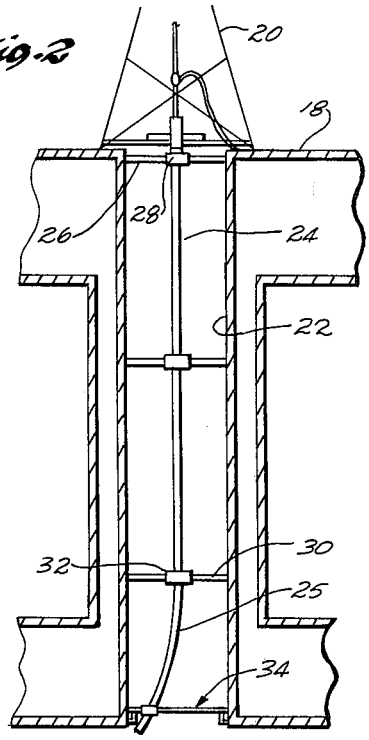
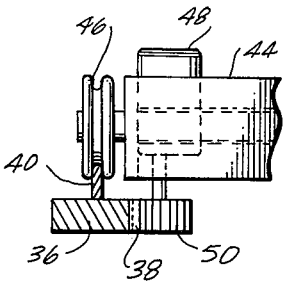
Fig. 4
Fig. 3
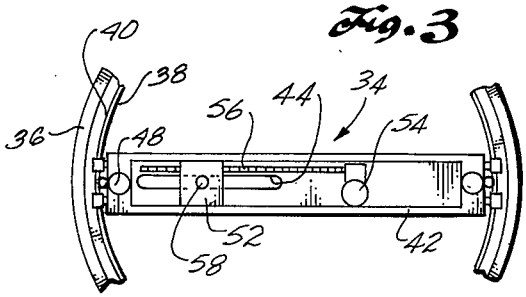

MONOPOD DRILLING PLATFORM WITH DIRECTIONAL DRILLING

FIELD OF THE INVENTION

This invention relates to offshore drilling structures, and more particularly, is concerned with a monopod semi-submersible drilling platform suitable for use in arctic waters proving directional drilling.

BACKGROUND OF THE INVENTION

With the increased interest in offshore recovery of oil, various types of drilling platforms have been developed for drilling on the bottom of the ocean from drilling rigs supported above the surface of the water. One type of drilling platform that is particularly well suited to operation in arctic waters in which ice flows are encountered is the monopod platform with ice cutters rotating around the outside of the supporting column. This platform derives its name from the fact that the platform is supported on a single vertical column from a submerged base structure. The buoyancy of the base structure can be controlled to vary the level of the base, permitting the platform to be utilized by supporting it directly on the bottom of the ocean at the drill site, or operating the platform as a semi-submersible floating platform.

In U.S. Pat. No. 3,871,184, for example, there is described a monopod drilling platform which rests on the ocean floor and can be shifted laterally to permit drilling of a number of wells in a relatively small area of the ocean floor. It is common to slant drill such wells so that the wells enter the producing formation at widely spaced locations.

When producing formations are relatively shallow, slant drilling of a number of wells from a common location may not provide as widely spaced locations as is desired for efficient operation. While more drilling sites may be prepared with fewer wells from each site, this obviously increases the expense of developing a field.

SUMMARY OF THE INVENTION

The present invention is directed to an arrangement for a monopod structure of the type described in the above-identified patent by which the direction of the drill as it enters the surface of the ocean floor is at a substantial angle from the vertical. Thus multiple wells can be drilled from the common location which diverge at a greater rate with increasing depth so as to achieve much wider spacing between the well bores where they enter the productive formation. This is achieved in brief by providing a conductor pipe extending from the upper platform through the moon pool. The conductor pipe has its longitudinal axis curved in an arc. The upper end of the conductor pipe is supported with the pipe substantially vertical. The lower end of the arcuate conductor pipe is supported with its longitudinal axis at an angle to the vertical axis corresponding to the angle of the arc of the conductor pipe. The supports for the conductor pipe are arranged to permit the conductor pipe to be rotated about the central axis of the moon pool so that the angular direction of offset of the lower end of the conductor pipe can be rotated about a vertical axis through 360°.

DESCRIPTION OF THE DRAWINGS

For a more complete understanding of the invention, reference should be made to the accompanying drawings, wherein:

FIG. 1 is an elevational view of the drilling platform;

FIG. 2 is a partial sectional view of the drilling platform showing details of the invention;

FIG. 3 is a cross-sectional view taken substantially on the line 3—3 of FIG. 2;

FIG. 4 is an enlarged detail view of the lower support structure; and

DETAILED DESCRIPTION

Figure 5:
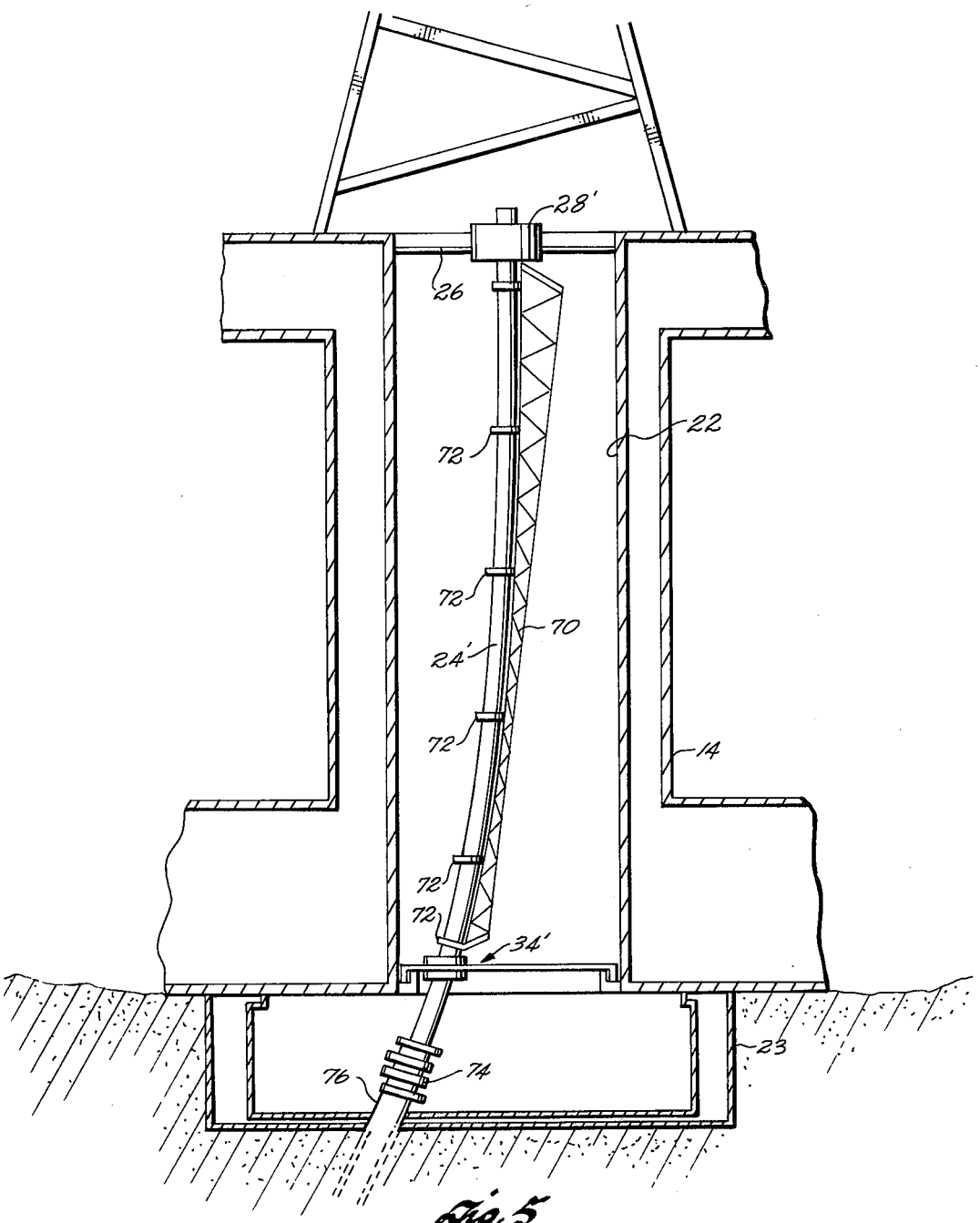
FIG. 5 is a cross-sectional view of an alternative embodiment of the invention.

Referring to FIG. 1, the numeral 10 indicates generally a monopod type drilling platform having a lower submerged base 12, a vertical supporting column 14, and an upper platform 16. The platform 16 includes a drilling deck on which is supported a conventional drilling derrick 20. Access to the ocean floor for drilling is through an open shaft or moon pool 22 extending from the drilling deck 18 down through the bottom of the base 12.

The base 12 is in the form of a hull which can be ballasted to change buoyancy of the structure in the water, permitting the structure to be operated as a semi-submersible vessel. Alternatively, the base can be flooded so that the flat bottom 13 comes to rest on the ocean floor. Site preparation, as decribed in copending application Ser. No. 458,986, filed Apr. 18, 1974, now U.S. Pat. No. 3,996,756, entitled "Method and Apparatus for Supporting a Drilling Platform on the Ocean Floor" and assigned to the same assignee as the present invention, may include excavating and leveling of the ocean floor to provide a suitable supporting surface on which the base rests. In addition, a cellar structure 23 is implanted in the ocean floor at the drilling site, the top of the cellar being made substantially flush with the leveled surface on which the base comes to rest.

Referring to FIGS. 2, 3, and 4, a conductor pipe 24 is provided which extends down through the center of the moon pool 22. The upper end of the conductor pipe 24 is supported below the rotary table of the rig by a suitable support bracket 26 bridging the upper end of the moon pool. The bracket supports the pipe through a rotary thrust bearing 28. If desired, a blowout preventor (not shown) may be mounted at the upper end of the conductor pipe 24. However, it is generally preferable to install the blowout preventer on the ocean floor to make it easier to pull the rig off location in an emergency.

The conductor pipe 24 extends down through the moon pool substantially along the center axis. One or more additional support brackets 30 may be provided having rotary support bearings 32 which permit relative rotation of the conductor pipe 24. The lower end of the conductor pipe 24 is bent in an arc as indicated at 25. Typically the amount of arc may be of the order of 6° per 100 ft. so that the lower end of the conductor pipe terminates below the moon pool at a substantial angle relative to the vertical axis of the moon pool. The radius of curvature of the arc is such that the desired angle of arc can be achieved within the diameter limits of the moon pool. The radius of curvature must also be consistent with the ability of drill string to pass freely through the curved portion of the conductor pipe. Obviously the shorter the length of the arc, the greater the possible angle of arc which can be accommodated within the diameter limitation of the moon pool.

The lower end of the conductor pipe, where it emerges from the bottom of the moon pool, is preferably supported by a rotating carriage assembly indicated generally at 34. The lower end of the moon pool 22 is formed with an inwardly projecting ring 36, the inner periphery of which forms an internal gear 38. A track 40 is supported on the ring 36. The rotating carriage assembly 34 includes a bridging frame 42. The frame is H-shaped in cross-section and has an elongated slot 44 extending radially down the center of the carriage. At either end of the carriage frame 42, a pair of guide wheels 46 are positioned to engage the track 40. A motor 48 drives a pinion 50 which engages the ring gear 38 for moving the ends of the carriage along the circular track, thereby rotating the carriage assembly.

A movable guide assembly 52 extends through the slot 44 and is slidable along the carriage frame 42 lengthwise of the slot. A drive motor 54 rotates a feed screw 56 which engages the guide assembly 52. Rotation of the feed screw functions to move the guide assembly 52 along the length of the slot 44. The conductor pipe 24 passes through an opening 58 through the guide assembly 52. As the carriage assembly 34 rotates within the moon pool, the radial offset of the guide member 52 moves through a circular path about the central axis of the moon pool. The guide assembly 52 in turn causes the conductor pipe 24 to rotate, thereby changing the radial direction of the lower end of the arcuate portion 25 of the conductor pipe. Radial movement of the guide means 52 over a limited range varies the angle between the longitudinal axis of the pipe at the lower end from the vertical.

The conductor may be preformed to the desired curvature or may be initially a straight pipe which is forced into a curved shape by the cross supports in the moon pool. For example, the radial adjustment of the rotating carriage can be used to offset the lower end of the conductor from the vertical axis thereby forcing the conductor into the curved shape.

In the alternative embodiment of FIG. 5, a conductor pipe 24' extends down through the moon pool 22. The upper end of the conductor pipe is rotatably supported by a bracket 26' bridging the top of the moon pool and a thrust bearing support 28' which permits the conductor pipe to be rotated about its longitudinal axis. The conductor pipe 24 is held in an arcuate shape by a lightweight truss 70. The conductor pipe is tied to the truss 70 by a plurality of strap members 72 which secure the conductor pipe to the truss and hold the conductor pipe in the desired arcuate shape. The conductor may be preformed or may be formed into an arcuate shape in the process of mounting it on the truss. The truss 70 and conductor pipe 24' rotates as a unit. The lower end of the conductor pipe 24 is supported by a rotating carriage assembly 34' similar to the carriage assembly 34 described above in connection with FIGS. 2 and 4.

The lower end of the conductor pipe 24' is connected through a blowout preventor 74 to the top of the surface casing pipe, indicated at 76, which extends through the bottom of the cellar 23 and is cemented in place in the formation.

From the above description it will be seen that by lateral movement of the drilling platform on the cellar, in the manner described in U.S. Pat. No. 3,871,184, a plurality of wells can be drilled through the bottom of the cellar. The direction of the wells as they enter the ocean floor through the bottom of the cellar can be pointed in any direction by rotation of the conductor pipe around the central vertical axis of the moon pool. While the upper end of the conductor has been shown as centered in the moon pool column, it can be offset, if desired, to allow for a greater degree of curvature within the confines of the moon pool. In such case it would be desirable to have all the cross supports rotate to change the direction of offset.

What is claimed is:

1. Apparatus for providing directional drilling from a monopod ocean drilling platform having a submerged base, a column extending up from the base and supporting a platform above the water, the column having a vertical moon pool extending downwardly from the platform and opening in the base, comprising:

a conductor pipe for receiving a drill stem extending from the platform through the moon pool, at least a portion of the conductor pipe curving in an arc, means rotatably supporting the conductor pipe in the moon pool adjacent the upper end, means supporting the conductor pipe in the moon pool adjacent the lower end at a position displaced from the center of the moon pool, and means for rotating said means supporting the conductor pipe about a vertical axis offset from the position of the conductor pipe.

2. Apparatus of claim 1 wherein the upper end of the conductor pipe is substantially vertical.

3. Apparatus of claim 2 wherein the upper and lower pipe supporting means are rotatable in the moon pool about a common vertical axis.

4. Apparatus of claim 3 wherein the lower pipe supporting means includes a carriage, a track around the inner periphery of the moon pool, the carriage being supported on the track and bridging the moon pool, and guide means positioned radially on the carriage relative to the central vertical axis of the moon pool, the conductor pipe being supported by the guide means such that radial movement of the guide means changes radial displacement of the lower end of the pipe while rotation of the carriage changes the angular position of the lower end of the pipe about the center of the moon pool.

5. Apparatus of claim 3 wherein the upper end of the conductor is supported in the center of the moon pool, the axis of rotation passing through the center of the moon pool.

6. Apparatus of claim 1 further including a rigid truss, and means attaching the conductor pipe along its length to the truss, the truss holding the conductor pipe in an arcuate position.

7. An offshore drilling structure, comprising a base, a deck, means supporting the deck on the base, the deck and base having an opening for access from the deck to the ocean floor for drilling, a conductor pipe extending from the deck through the base through said opening, means supporting the conductor pipe in the opening, the conductor pipe having a portion curved in an arc, the upper end of the pipe being substantially vertical and the lower end terminating at an angle to the vertical, and means for rotating the supporting means about a vertical axis at the center of the opening.

8. Apparatus of claim 7 further including truss means extending along the length of the conductor pipe, and means securing the pipe to the truss to hold the pipe in said arcuate shape.

9. Apparatus of claim 6 wherein the conductor is preformed into an arc.

10. Apparatus of claim 6 wherein the conductor is held in an arc of constant curvature by the supporting means.

* * * * *